United States Patent [19]

Pellegrino

[11] 4,174,261

[45] Nov. 13, 1979

[54] APPARATUS FOR ELECTROPLATING, DEPLATING OR ETCHING

[76] Inventor: Peter P. Pellegrino, 2642 W. Mendoza, Mesa, Ariz. 85202

[21] Appl. No.: 895,744

[22] Filed: Apr. 13, 1978

Related U.S. Application Data

[63] Continuation-in-part of Ser. No. 705,827, Jul. 16, 1976, abandoned.

[51] Int. Cl.[2] ..... C25D 17/00; C25F 7/00

[52] U.S. Cl. ..... 204/273; 204/275

[58] Field of Search ..... 204/273, 275, 284, 276, 204/224 R, 129.6

[56] References Cited

U.S. PATENT DOCUMENTS

| | | | |
|---|---|---|---|
| 593,837 | 11/1897 | Dunton | 204/273 |
| 1,431,022 | 11/1922 | Mumford, Jr. | 204/273 |
| 2,895,814 | 7/1959 | Clark | 204/224 R |
| 2,937,124 | 5/1960 | Vaughan | 204/129.6 |
| 2,958,636 | 11/1960 | Hershinger | 204/129.6 |
| 3,071,521 | 1/1963 | Ehrhart | 204/224 R |
| 3,300,396 | 1/1967 | Walker | 204/284 |
| 3,503,856 | 3/1970 | Blackmore | 204/273 |
| 3,824,137 | 7/1974 | Bok et al. | 204/273 |
| 3,963,588 | 6/1976 | Glenn | 204/16 |
| 4,029,564 | 6/1977 | Higuchi | 204/275 |

FOREIGN PATENT DOCUMENTS

| | | | |
|---|---|---|---|
| 763863 | 5/1934 | France | 204/15 |
| 986 | of 1896 | United Kingdom | 204/DIG. 7 |

*Primary Examiner*—T. M. Tufariello

*Attorney, Agent, or Firm*—Blakely, Sokoloff, Taylor & Zafman

[57] ABSTRACT

Methods and apparatus for providing high and uniform processing rates for electroplating, deplating, etching and the like, substantially independent of the surface geometries of the article subjected to the process. In an electroplating application, the article to be plated is supported on a cathode so the electrolyte may be forcibly sprayed on the article from an array of spray nozzles adjacent the surface thereof. Intermixed with the array of spray nozzles may be a second array of openings providing suction to locally remove most of the sprayed electrolyte after impingment on the work piece. In this manner most of the spent electrolyte is removed from the work piece locally so that it is not available to flow down the work piece to shield the surface thereof from the spray of lower nozzles. One or more additional intermixed arrays of delivery ports may also be used to deliver such things as inert gases, brighteners, polishing media, air under pressure to increase agitation, etc., either on a continuous basis or on an intermittent basis as desired. Uniformity over the work piece area is assured by random oscillation of the work piece in an amount on the order of the nozzle spacing. The methods and apparatus are applicable to other electrical processes such as deplating, and non-electrical processes such as etching and cleaning.

28 Claims, 16 Drawing Figures

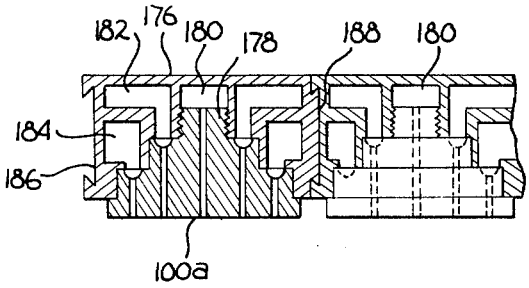
Fig. 14
Fig. 13
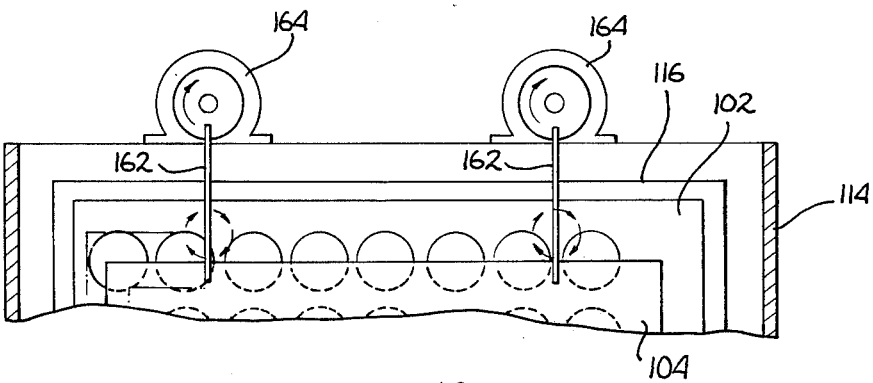
Fig. 15
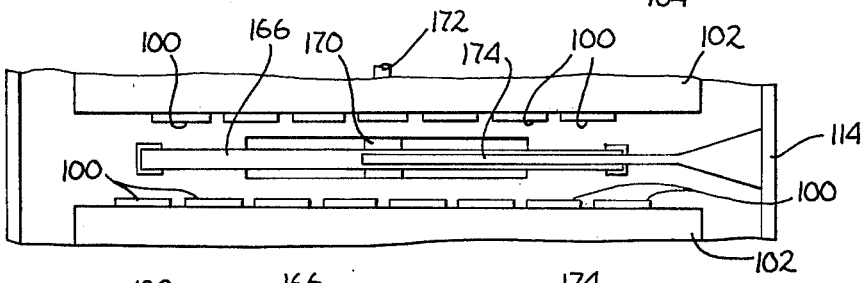
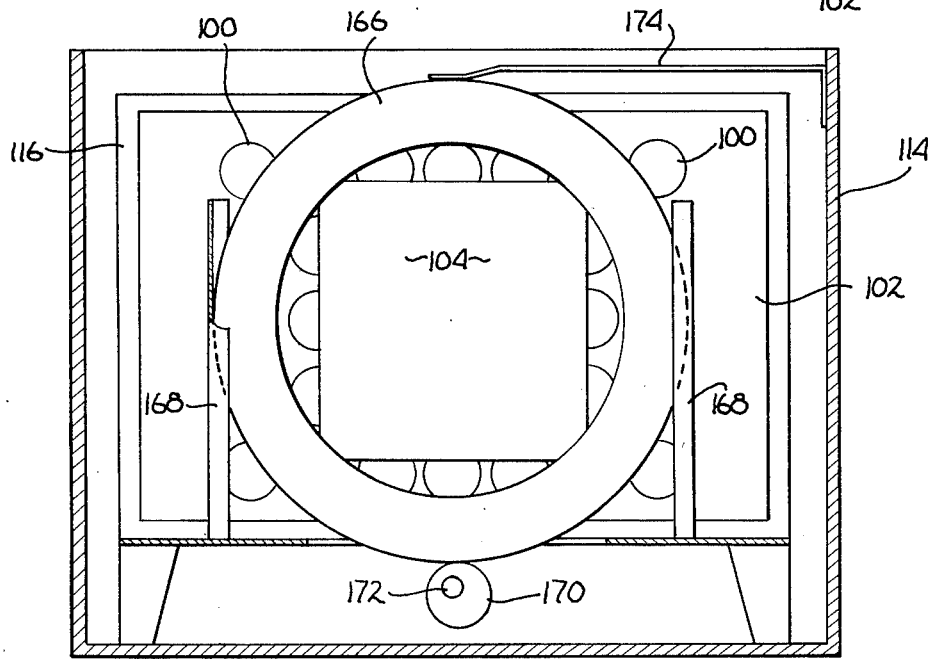
Fig. 16

APPARATUS FOR ELECTROPLATING, DEPLATING OR ETCHING

CROSS REFERENCE TO RELATED APPLICATIONS

This application is a continuation-in-part of my copending application entitled "ELECTROPLATING METHOD AND APPARATUS", filed on July 16, 1976, as Ser. No. 705,827 now abandoned.

BACKGROUND OF THE INVENTION

1. Field of the Invention

The present invention relates to the field of electroplating.

2. Prior Art

Electroplating methods and apparatus are very well known in the prior art, and are used on an everyday basis for such purposes as applying protective and decorative metal platings or coatings to a wide variety of metal products, including stampings, castings, extrusions and the like. Various methods are also known for electroplating nonconductive materials, such as by way of example, plastics, by first applying a thin conductive layer so that the electroplating process may be utilized. Such initial conductive layers may be applied by such means as electroless plating techniques, by coating with a conductive paint or similar material, or even by the use of a thin metal plating deposited by vapor deposition techniques.

Prior art electroplating methods and apparatus utilize a bath of an electrolyte which is rich in the ions of the metal to be plated. The parts to be plated are immersed in this electrolyte bath and are electrically coupled to a cathode or negative terminal of an appropriate electrical power supply. Typically also immersed in the electrolyte are one or more bars of the metal to be plated which in turn are electrically coupled to the positive terminal of the power supply. Basically some of the metal ions in the electrolyte adjacent the parts to be plated deposit onto the part and are electrically neutralized, with the ions being replaced at the anode by the gradual ionization and passage into solution of the anode metal. Thus a prior art electroplating system has a closed electrical circuit which includes not only the part being plated and the anodes of the plating metal but also the path of electrolyte therebetween, with the flow of the electrical current in the electrolyte being a result of the flow of metal ions from the anode to the part being plated. Thus the rate of plating in prior art systems is limited by the rate at which the metal ions may reasonably be caused to flow through the electrolyte and provide a good quality plated surface, a factor which is particularly limited on articles having sharp edges or projections, as points, edges, and the like tend to concentrate the electric field at that region to cause local burning or a low quality plating on the article being plated. Accordingly plating rates in prior art systems are limited, and are particularly limited in plating rates for articles having protruding edges, corners and the like.

The plating of articles having holes, depressions and the like is also highly limited in prior art plating systems. In an unagitated electrolyte, the metal ions proceed through the bath in accordance with the electric field therein. Since the electric field surrounding a hole is highest in the region of the mouth of the hole, and grossly diminishes along the length of the hole, the electrolyte within the hole becomes starved for the metal ions, with the result that the plating rate therein is very low compared to the plating rate at the mouth of the hole and at other regions of the part being plated.

One method used in prior art electroplating equipment for increasing the plating speed and obtaining better plating of holes and other shaded areas on the article being plated is to agitate the electrolyte by such means as pumps, mixers and the like, or the passage of air therethrough. This agitation or circulation mechanically aids in the transport of the ions from the anode to the part being plated, and also aids in the penetration of the ion rich electrolyte into holes and depressions in the article being plated. However, characteristically high agitation of the bath is required to cover all areas of the items being plated, with the net result that plating rates in holes and depressions are still substantially lower than on direct flat surfaces. By way of example, plating rates in the through holes in printed circuit boards are on the order of fifty percent or less of the plating rate achieved on the board face. Also the use of air as opposed to other means for circulating the electrolyte tends to decrease the plating rate because of the fact that the air displaces the electrolyte and diminishes the transport of the metal ions by the electric field.

Typical plating solutions often contain at least small amounts of organic compositions and/or other non-conductive constituents which, if deposited or allowed to accumulate on the surface of the article being plated, will interupt the plating at that local region. While agitation of the electrolyte tends to diminish this effect it does not always eliminate such accumulations.

Agitating methods and apparatus for agitating the electrolyte in electroplating tanks is well known, as exemplified in U.S. Pat. Nos. 593,837; 1,431,022; 3,503,856 and 3,963,588. All of these methods envision forms of spray apparatus for positioning below the electrolyte level, with the spent spray passing into the bulk of the tank, though the last of these patents contains the solitary statement that such immersion is not a requisite to effective electroplating, and that the electrolyte issuing from the housing may simply be conducted to a reservoir tank and recycled, as necessary, back to the inlet.

Other systems for delivering an electrolyte to the surface to be plated through the use of some form of pump arrangement are also known. By way of example, in the system disclosed in the British Pat. No. 986, a pump is used to deliver an electrolyte through a tube C directly onto the face of the article to be plated. It is apparent from the disclosure in that patent, however, that the entire article is immersed in the electrolyte, as the return line is placed above both anode and cathode. In French Pat. No. 763,863 a system for spot plating is disclosed wherein an electrolyte is allowed to flow downward onto the local region to be plated, with the electrolyte then running off to the collection region therebelow. Also, the use of spraying apparatus in various forms is known with respect to non-electrical processes, such as in etching (U.S. Pat. No. 2,895,814) and in treatment liquids of various kinds (U.S. Pat. No. 3,824,137). Finally, anode containers of various kinds are also known such as those disclosed in U.S. Pat. No. 3,300,396.

BRIEF SUMMARY OF THE INVENTION

Methods and apparatus for providing high and uniform processing rates for electroplating, deplating, etching and the like, substantially independent of the surface geometries of the article subjected to the process. In an electroplating application, the article to be plated is supported on a cathode so the electrolyte may be forcibly sprayed on the article from an array of spray nozzles adjacent the surface thereof. Intermixed with the array of spray nozzles may be a second array of openings providing suction to locally remove most of the sprayed electrolyte after impingement on the work piece. In this manner most of the spent electrolyte is removed from the work piece locally so that it is not available to flow down the work piece to shield the surface thereof from the spray of lower nozzles. One or more additional intermixed arrays of delivery ports may also be used to deliver such things as inert gas, brighteners, polishing media, air under pressure to increase agitation, etc., either on a continuous basis or on an intermittent basis as desired. Uniformity over the work piece area is assured by random oscillation of the work piece in an amount on the order of the nozzle spacing. The methods and apparatus are applicable to other electrical processes such as deplating, and non-electrical processes such as etching and cleaning.

BRIEF DESCRIPTION OF THE DRAWINGS

FIG. 13 is a view of a portion of the apparatus of FIG. 8 illustrating the manner of imposing a random motion to the article to be plated.

FIG. 14 is a partial cross-section of an alternate manifold assembly construction.

FIG. 15 is a top view of an alternate work piece clamp and random motion-inducing system.

FIG. 16 is a side view of the apparatus of FIG. 15.

DETAILED DESCRIPTION OF THE INVENTION

Figure 1:
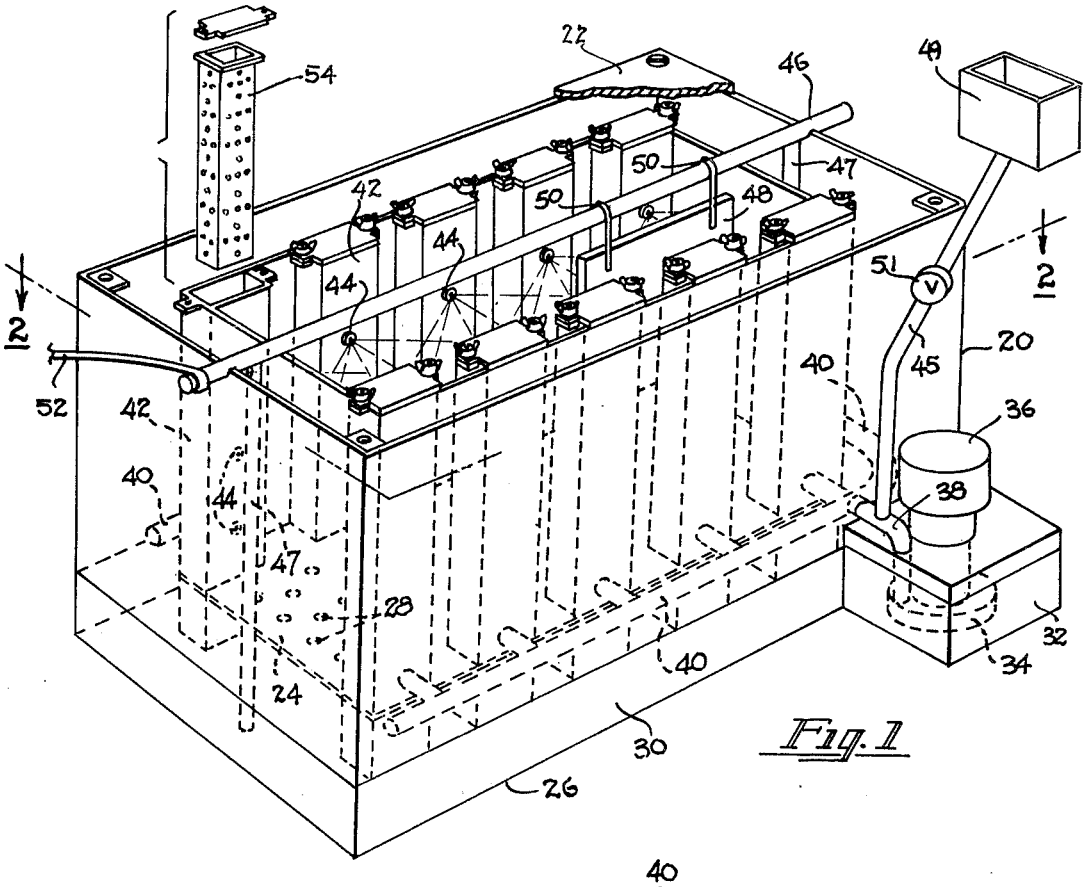
FIG. 1 is a perspective view of one embodiment of the present invention.
Figure 2:
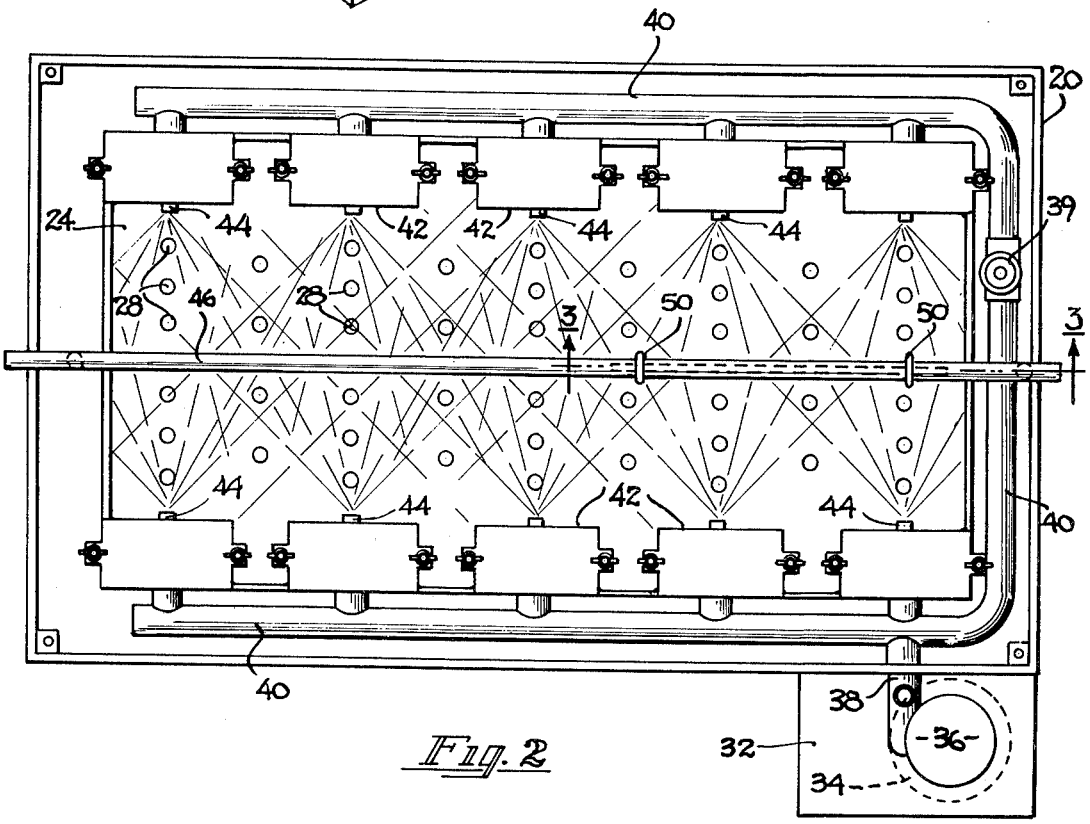
FIG. 2 is a top view of the embodiment of FIG. 1 taken along line 2—2 of that FIGURE.

First referring to FIG. 1, a perspective view of one embodiment of the present invention may be seen. This embodiment is comprised of a rectangular tank 20 having a removable top 22 for closing and sealing the top thereof. Mounted within the tank 20 is a floor plate 24 disposed somewhat above the bottom 26 of the tank 20. The floor plate 24 has a plurality of holes 28 therein so as to allow the flow of electrolyte therethrough, thus providing a sump region 30 under the plate 24 for the collection of the electrolyte. The sump region 30 is continued into region 32, in which is mounted a pump 34 driven by a motor 36 to deliver electrolyte under pressure through line 38 and manifold 40 to a plurality of vertically disposed rectangular chambers 42. As shall subsequently be described in greater detail, these chambers are normally sealed at the top thereof, and contain balls or other pieces of the metal to be deplated which are electrically coupled to the anode of a power supply. On the inward directed faces of the chambers 42 are a plurality of spray nozzles 44 which spray the electrolyte toward the center of the tank. A horizontal bar 46 is disposed between the chambers 42, and is elevated somewhat with respect thereto so that parts to be plated such as the printed circuit board 48 may be electrically and mechanically supported therefrom by wire supports 50. It will be noted that the elevation of the bar 46 which is coupled to the negative terminal of a power supply through lead 52 disposes the parts to be plated at the same elevation as the chambers 42 to receive a direct impingement of the spray from nozzles 44. Of course, the preferred embodiments shown herein is for the plating of printed circuit boards and other generally flat objects. It will be understood, however, that for objects of more complicated geometries or of more three dimensional character, the spray nozzles may be disposed in various patterns and directed in various directions so as to provide essentially three dimensional coverage of the object being plated. By way of specific example, the spray nozzles might even be disposed on adjustable manifold arms to allow adjustment in their position and direction dependent upon the nature and geometry of the article to be plated. Further, if desired, the article being plated may even be rotated to assure even more uniform impingement of the spray, and thus highly uniform plating rates over the entire surface of the article. Also, a highly direction oriented plating may be achieved by carefully directionally controlling the spray onto the article being plated. By way of example, when plating precious metals, costs may be minimized by confining the plating only to those surfaces where plating is desired or required. As a specific illustration, in the plating of watch cases only the outer surfaces need be plated, an objective which may readily be achieved with the present invention by an essentially unidirectional orientation of the spray on the articles to be plated. In essence this may be accomplished with the apparatus illustrated in the drawings by a simple valve 39 placed in the electrolyte manifold so that the spray nozzles at one side of the apparatus may be shut off, leaving only the spray from one side of the plating apparatus.

Having now described the general organization of one embodiment of the present invention, the operation thereof will now be described. Bar 46 forms the cathode connection in the tank, on which the articles to be plated may be supported in a conventional manner. The tank itself is filled with electrolyte to a level just below the plate 24 so that articles to be plated, such as the printed circuit board 48, will be suspended from the cathode bar 46 at an elevation above the electrolyte level. In certain embodiments, side extensions 47 of the cathode bar 46 extend downward past the ends of the plate 24 into the electrolyte bath so as to provide a completed plating circuit even before the spray nozzles are turned on. In essence this allows the parts to be plated to go into the bath "live" and allows the establishment of the plating voltages prior to the spraying of the article to be plated with the electrolyte. (This helps avoid one of the problems of the prior art often encountered when parts are dropped on the cathode bar and current is not immediately established. In particular such an occurrence results in some atoms of the metal being plated being superficially attached to the part, yielding poor adhesion. The present invention allows parts to sit in air, wetted from prior cleaning, and to become live on contact with the electrolyte.) When motor 36 is turned on the electrolyte is supplied under pressure into the chambers 42 and sprayed through nozzles 44 against the part to be plated, with the run-off therefrom passing through the openings 28 in plate 24 into the sump region for recirculation by the pump. Since plating is desired on the part 48, the electrolyte sprayed through nozzles 44 must be rich in the ions of the metal being plated, and accordingly a primary source of metal ions must be provided in the system. For convenience, the metal ions are provided by balls or other pieces of the metal (including solid anodes) being plated disposed within the chambers 42 so that the electrolyte supplied thereto through manifold 40 is enriched in metal ions before passing through the nozzles 44.

Electrically the plating processes of the present invention, in comparison to conventional electroplating processes, may be described as follows. In conventional electroplating processes, plating occurs as a result of the attraction between the metal ions (positively charged) in the electrolyte surrounding the part to be plated and the part itself, which is maintained at a negative voltage. Thus it is the local ion flow immediately adjacent the part to be plated which achieves the desired result. Obviously, however, if the ions in the electrolyte were not continuously replenished, such as by the flow of such ions through the bulk of the electrolyte, the electrolyte immediately surrounding the part would quickly become depleted of metal ions, terminating the plating action until the ions are replenished. Accordingly, in the present invention, replenishment of the electrolyte immediately adjacent the part to be plated is accomplished by mechanically continually delivering fresh electrolyte to the surface of the part, more particularly by spraying fresh electrolyte onto the surface of the part to keep the electrolyte adjacent the part in an ion enriched state. Obviously there will also be a continual flow of electrolyte off of the part and into the sump for recirculation, that is for replenishment of the ion content and respraying onto the part.

The process of the present invention utilizing the spraying of the electrolyte onto the part has a number of very substantial advantages over the bath-type electroplating processes of the prior art. Plating rates are not limited by the flow of metal ions through the bulk electrolyte, or the extent to which one might create turbulence in the electrolyte. Accordingly higher plating rates may be achieved with less electrical power being required. Also the spraying results in good delivery of the electrolyte to all regions of the part being plated, including depressions and holes, so that the surfaces of the part within the depressions and holes is not subjected to depleted electrolyte. (The word depleted as used herein and in the appended claims is not to be limited to the extreme, e.g., total exhaustion of ions, but is used in the more general sense to denote generally diminished or decreased ion content.) The plating rate achieved when forming plated through holes on printed circuit boards, by way of example, is substantially the same as that achieved on the face of the printed circuit board. This is to be compared with a plating rate in plated through holes using prior art techniques of approximately fifty percent or less of the plating rate on the face of the circuit boards.

In addition to the foregoing there are further advantages to the use of the present invention. Typically, substantially less electrolyte is required for plating parts of a given size, an economic factor particularly important in the plating of precious metals such as gold, silver, rhodium, etc. Also the fluid dynamic effects of the spray on the part being plated tends to automatically remove any nonconductive debris or accumulation on the part by force, thereby enhancing the quality of the plating achieved and avoiding the undesirable consequences of the accumulation of nonconductive films on the part. In the prior art, these conditions limited the current which could be used without burning of the part. In that regard, common plating solutions normally contain at least small amounts of organic compositions and/or other nonconductive constituents which may accumulate on the surface of the part being plated to locally interupt plating until they are removed. In the prior art, agitation and/or bubbling of air through the electrolyte are used in an attempt to break up and remove these films. The results achieved in the prior art, however, are less than ideal, and it is common when using the conventional electrolyte path for the operator to periodically remove the part from the plating tank for visual inspection, and scrubbing for removal of any such films if necessary, before plating is allowed to proceed. In the present invention the tendency to mechanically break up these films tends to automatically achieve the same result as the mechanical scrubbing sometimes required with prior art processes. It should be noted that a number of such factors depend upon the condition of the electrolyte, and since less electrolyte is required in the present invention, the economic consequences of discarding an old solution are much less. Further advantageous results may be achieved by adding a small percentage of small glass shot or fine ceramic media to the electrolyte which will be pumped through the spray heads together with the electrolyte. This additional abrasive force further breaks down the nonconductive surface and provides a method to further increase the allowed current flow, resulting in faster plating and more uniform coatings. The media such as a fine pumice or glass beads as commonly used in deburring machines will in general circulate through the system without damage thereto, as normally the electrolyte pump is a simple centrifugal pump suitable for pumping fluids having at least a fine particulate matter therein.

Figure 3:
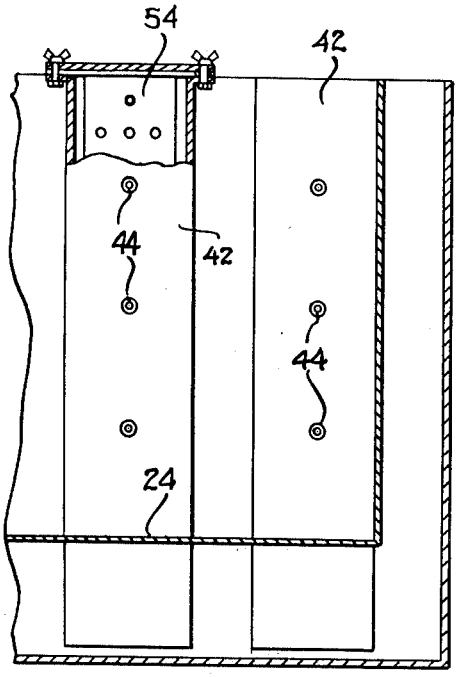
FIG. 3 is a partial cross-sectional view taken along line 3—3 of FIG. 2.
Figure 5:
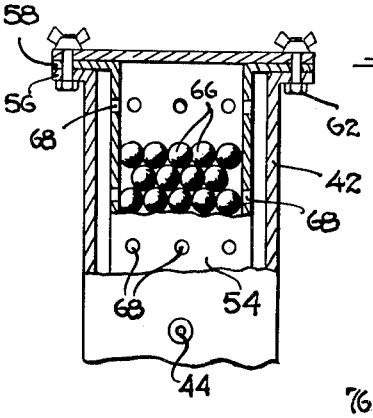
FIG. 5 is a portion of FIG. 3 taken on an expanded scale.

Having now described the basic plating process used in the present invention, further details of the structure of the embodiment of FIG. 1 will be given. Preferably the tank 20 is constructed from plastic or a plastic lined metal, or in the alternative, is a metal tank non-reactive with the plating solutions to be used therein. Similarly plate 24 is preferably plastic, as are the impeller and other parts of pump 34. The line 38 and manifold 40, as well as chambers 42 and spray nozzles 44, are preferably plastic. Located within the chambers 42 are metal basket members 52, details which may be better seen in FIGS. 3 and 5. In particular the tops of chambers 42 are provided with flanges 56 which may receive similar flanges 58 on the baskets 54. The chambers 42 are sealed by top plates 60 retained in position by bolts 62 and wing nuts 64 passing through the flanges of the chamber 42 and basket 54, thereby providing quick access to the interior of the chamber and easy removal of the basket 54. The basket 54 of course is used to retain pieces of the metal to be plated, such as by way of example in the case of copper, copper balls 66, so that electrolyte may flow between the pieces of the metal to be plated for replenishment of the ion content and outward through holes 68 in the basket 54 for spraying through nozzles 44.

In order to achieve the desired plating, electrical contact must be made to the metal to be deplated, specifically balls 66. Accordingly in the preferred embodiment the basket 54 is a metal basket fabricated from a metal which is non-reactive to the electrolyte being used. The word non-reactive as used herein with respect to certain metals is used to indicate that the metal will not significantly ionize or go into solution with the electrolyte, and thus will not plate out on the part being plated. Examples of such metals for common plating solutions include titanium, monel and stainless steel. Accordingly electrical contact is made to the metal to be plated by making electrical contact to the flange 58 of the basket, which may be achieved by a conductive strip placed under the caps 60 or in the alternative by using metal caps for caps 60 and making electrical contact thereto. (Bolts 62 and wing nuts 64 may be of a non-reactive metal or plastic, as desired.)

Figure 6:
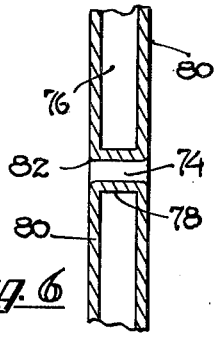
FIG. 6 is a cross-sectional view of a printed circuit board taken through a plated through hole plated in accordance with the method and apparatus of the present invention.
Figure 4:
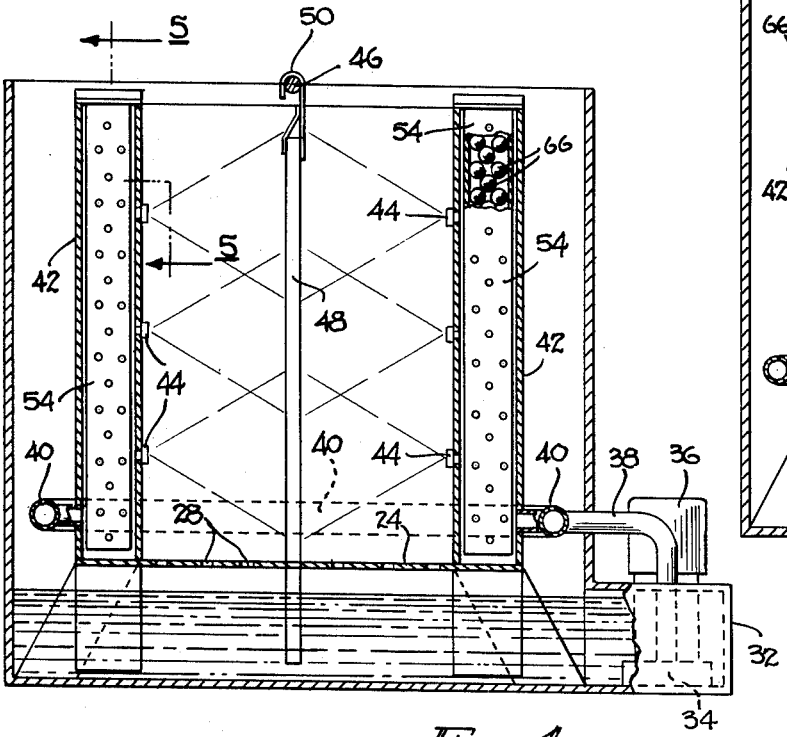
FIG. 4 is an end view, partially cut away, of the embodiment of FIG. 1.
Figure 7:
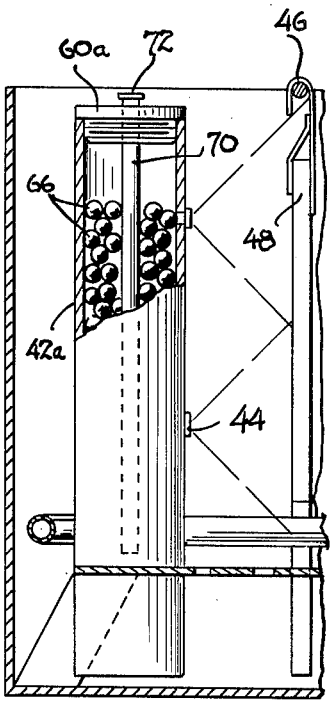
FIG. 7 is a side view, partially cut away, of a portion of an alternate embodiment of the present invention.

In the embodiment just described the baskets 54 may be readily removed in their entirety, thereby facilitating the easy removal of the remaining pieces of the metal to be plated before their size diminishes to the point of being able to pass through the openings 68 in the baskets and/or to clog the spray nozzles. An alternate embodiment however is shown in FIG. 7. In particular, in this FIGURE, the chambers **42*a* are cylindrical rather than rectangular as in the prior embodiment, and as before have a plurality of nozzles 44 disposed so as to spray electrolyte against an article 48 to be plated. The chambers 42*a* are internally threaded at the top thereof to receive a screw cap 60A so as to seal the top opening in the cylindrical chamber 42*a*, yet allow easy access thereto (parts identified with a numeral followed by the letter "a" in FIG. 7 and the description thereof are of an alternate design but of a similar function as the parts previously described with respect to the first embodiment and identified in FIGS. 1 through 6 with the same numeral). Mounted through the top cap 60*a* is a non-reactive metal anode 70 which makes contact with the metal balls 66 within the chambers 42*a* and which is accessible at the top 72 thereof for coupling to the positive power supply terminal. As before, extensions of the cathode penetrate the sump region for emersion in the electrolyte. Functionally this embodiment is substantially the same as the previously described embodiment, though is perhaps somewhat easier to fabricate because of the tubular sections, etc. Of course if desired the metal pieces 66** may be contained within a bag formed of plastic or fiberglass screening material so as to facilitate the easy removal of the metal pieces if desired, and to act as a filtration media for fine grain structures.

In certain embodiments it is desirable to flood (fill) the enclosure with electrolyte when the apparatus is not being used so that the spray heads are immersed in the electrolyte to prevent drying and clogging thereof. Accordingly for this purpose a line 45 coupled to the output of the pump 34 is extended to a holding tank 49 shown schematically in FIG. 1, with a valve 51 in the line 45 for controlling the flow therein. Accordingly when the apparatus is not being used, valve 51 may be opened, allowing the contents of the holding tank 49 to drain back into the tank 20 to fill the tank to a level above the upper spray nozzles. When the apparatus is to be used again, valve 51 is opened and motor 36 started, so that the normal spray pressure in manifold 40 will cause substantial flow in line 45 to pump the electrolyte out of tank 20 into the holding tank 49, with valve 51 being closed when the desired level of electrolyte in tank 20 is achieved. (In addition to all the features described above, regarding spray of electrolyte, it is also possible to use this apparatus as a standard tank by keeping it full of electrolyte, and not spraying. Also, the standard tanks used in the present art can be retrofitted and converted to this new art.)

One of the primary advantages of the present invention is its ability to achieve relatively high plating rates within depressions and holes in the article to be plated, and more particularly relatively high plating rates in such areas substantially equal to the plating rates on the areas directly facing or in line with the anodes. This is illustrated in FIG. 6, which is a cross section taken through a hole 74 in a printed circuit board 76. As shown in the FIGURE, the plating rate in the region 78 is substantially the same as on the surface areas 80, and higher overall plating rates may be achieved in comparison with the prior art on sharp corners and edges without burning, such as at the edges 82 of the holes.

Another advantage of the present invention is to achieve highly agitated electrolyte movement on the surfaces on which plating is desired, and simultaneously to substantially avoid electrolyte contact with other surfaces where plating is not desired. In general, it was not possible in the prior art to plate metal only on certain specific surfaces without masking of the part, an operation which in and of itself is relatively expensive because of the individual handling of the parts required. The present invention, on the other hand, allows the directing of the spray only onto those surfaces where plating is desired, resulting in substantial economic savings, particularly when plating precious metals such as gold, silver, rodium and the like. Further, gold by its nature must be rapidly agitated, with prior art methods resulting in serious burning and high density problems. The spray plating of the present invention improves the movement of the gold electrolyte past the part and puts the gold or other precious metal on the surfaces where it is desired and does the most functional and wear resistant job possible. If desired, shrouds and/or air streams can direct the electrolyte away from certain portions not requiring plating at all, as in internal sections so as to achieve the desired result without requiring an expensive individual masking operation.

There has been described herein a new and unique process for electroplating, together with two embodiments of unique apparatus for carrying out the process. It should be noted, however, that the process of electro-etching is in effect a plating process with reverse polarity. Accordingly by reversing the anode and cathode connections such as with respect to the embodiment shown in FIG. 7, the part 48 may be electro-etched, with the metal etched away from the part being electro-deposited to the electrode 70 (and any other metal parts coupled to the negative power supply terminal). In the case of electro-etching, metal ion depleted electrolyte is sprayed onto the part to be etched, with the metal on the part being etched passing into solution in the form of metal ions in the electrolyte for collection in the sump and plating out on the electrode 70 (in this case the cathode). Accordingly electroplating, as used in this specification and appended claims, is used in the general sense, and includes electro-etching as a form of electroplating whereby metal is removed from a part and plated out such as on a fixed electrode in the electroplating (electro-etching) apparatus.

Figure 8:
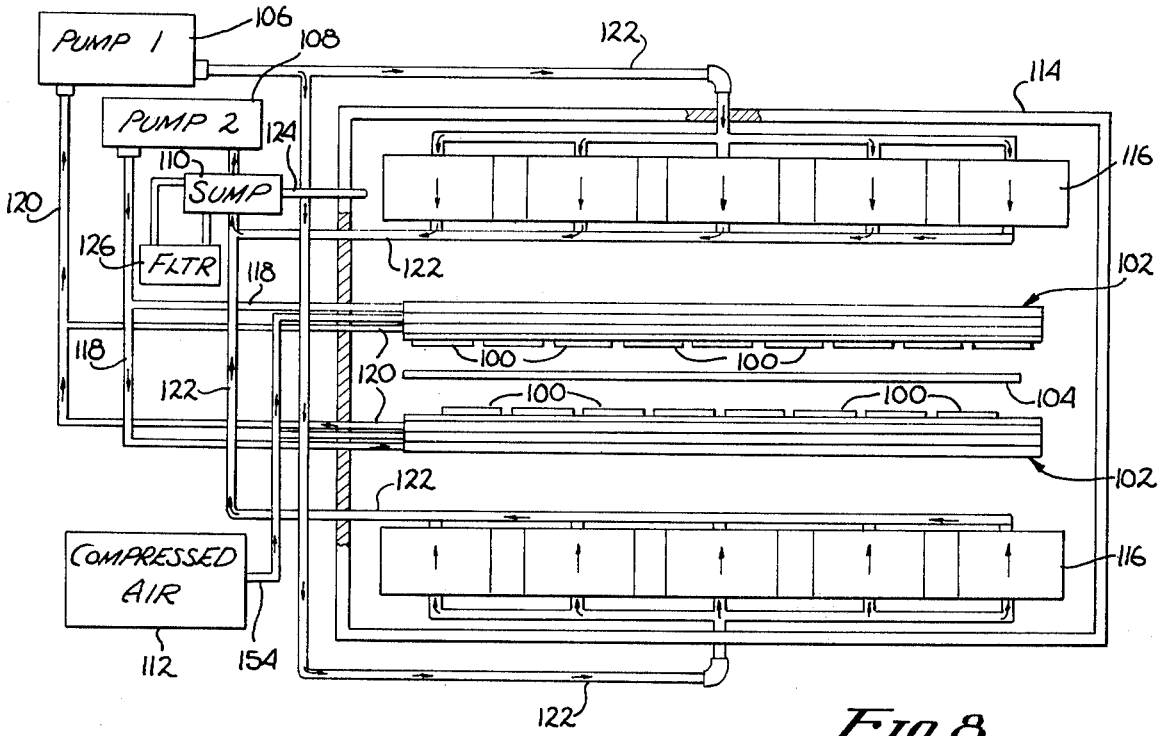
FIG. 8 is a top view of another embodiment of the present invention with the flow systems illustrated schematically.

Now referring to FIG. 8, a top view with the cover removed of a further alternate embodiment of the present invention may be seen. This embodiment is similar to the previously disclosed embodiments in that it utilizes an array or matrix of spray nozzles to direct fresh electrolyte onto the surface of the part to be plated. However, it differs from the earlier embodiments in certain very important ways to further enhance the control available and the plating rate and quality that may be achieved. In particular, a second array of openings or ports is intermixed with the spray nozzles or ports, which in turn are effectively manifolded to a pump for locally removing the spent (actually, partially spent) electrolyte from the area of the work piece so that the spent electrolyte, which had been initially delivered by a particular nozzle, does not linger in the vicinity of that nozzle to interfere with the continuous impingement of fresh electrolyte onto the work piece from that nozzle, and is not free to run down the part to be plated so as to effectively mask other spray nozzles. This is an extremely important aspect of this embodiment and the embodiments to be subsequently described, as it provides not only the continuous delivery of fresh electrolyte by the spray nozzles or delivery ports as in the previous embodiment but further incorporates the feature of removing the electrolyte locally as well. Finally, a third (or more) array of openings is provided interleaved with the first two arrays for such purposes as the delivery of compressed air to confine and enhance the impingement of the electrolyte onto the part being plated. In that regard, this third array of openings, or for that matter, additional openings, may be used for other purposes such as, by way of example, the continuous or intermittent delivery of a polishing grit, fine glass beads, etc., as may be desirable for such purposes as the removal of contamination, particularly nonconductive surface build-up from the part being plated.

The illustration of the embodiment of FIG. 8 is somewhat schematic for purposes of explanation, as certain structural details are the same or obvious modifications of the corresponding structure utilized in the previously disclosed embodiments. In particular, in this embodiment a series of heads 100 are disposed in arrays on manifold assemblies 102 so as to face the opposite surfaces of a work piece such as a printed circuit board 104 suspended therebetween. (The mechanism for suspending the printed circuit board for purposes of clarity is not shown in FIG. 8, though it is illustrated in detail in subsequent figures.) The manifold assemblies 102 in turn are coupled to a first pump 106, a second pump 108, a sump 110 and a source of compressed air 112. Also disposed within the general confines of the enclosure 114 are a pair of ion replenishment tank assemblies 116, also coupled to the pump 106 and sump 110. In particular, pump 108 receives ion-rich electrolyte from the sump 110 and delivers the electrolyte at a relatively high pressure through line 118 for delivery onto the work piece through the manifold assemblies 102 and heads 100. At the same time, pump 106 is sucking electrolyte away from the region of the work piece through lines 120 and delivering that electrolyte through lines 122 to the ion replenishment tank assemblies 116 for re-enrichment of the electrolyte. In that regard, the tank assemblies 116 may be very similar to the tank assemblies shown with respect to the embodiment of FIGS. 1 and 2 utilizing removable nonreactive metal baskets within enclosures for confining pieces of the metal to be plated for exposure of relatively large surface areas to the electrolyte flowing therethrough. In distinction to these earlier assemblies, however, the assemblies of the present embodiment do not themselves have the spray nozzles mounted thereon, but instead have the outlets thereof manifolded together through lines 122 to deliver the enriched electrolyte to the sump 110 for reuse by pump 108. In that regard, sump 110, shown schematically in FIG. 8, may be provided with an overflow 124 into the main enclosure 114, with lines 120 also drawing some electrolyte from the tank 114 as well as removing electrolyte directly from the area of the part being plated, so that all electrolyte is eventually recirculated, though more electrolyte may be present in the system than may be held in the sump 110 for storage of the enriched electrolyte. (As an alternative, conventional anodes may be disposed in the sump or elsewhere for ion replenishment.)

As previously mentioned, the basic concept of the embodiment of FIG. 8 is that not only is fresh electrolyte delivered under pressure to the area of the part being plated, but also spent electrolyte is being locally removed from the part being plated so that each head 100 may operate relatively independently of the adjacent heads. This assures uniform conditions across the entire area to be plated, as each head 100 operates relatively independently of the "runoff" from other heads. In that regard, because of the lack of build-up of spent electrolyte in the region of the work piece under any condition with this apparatus, the apparatus may be operated with the electrolyte level in the enclosure 114 well below the level of the article being plated, as is the case with the earlier embodiments or, alternatively, may be operated with the part entirely immersed in electrolyte. It has been found that for bulk plating relatively large articles it is perhaps preferable to operate with the article being plated immersed below the electrolyte level, whereas suspension of the article above the electrolyte level is preferable for finer work. In either case, sump 110 may actually be a segregated portion of the enclosure 114 sheltered so as to not receive spent electrolyte from the part being plated, with the overflow therefrom passing into the main area of the tank.

In addition, in the preferred form of this embodiment a pump and filter 126 is coupled to the sump 110 to constantly remove, filter and return the enriched electrolyte in the sump so that the level of particulate matter in the electrolyte may be maintained relatively low.

While a filter could be placed if any of the other pump lines rather than utilizing a separate pump for filtering purposes, it has been found that a separate pump is desirable as the fluid flow rates in relatively fine filters are lower than the flow rates desired in the two main electrolyte circuits of the system, and 100% filtering is not required anyway.

Figure 9:
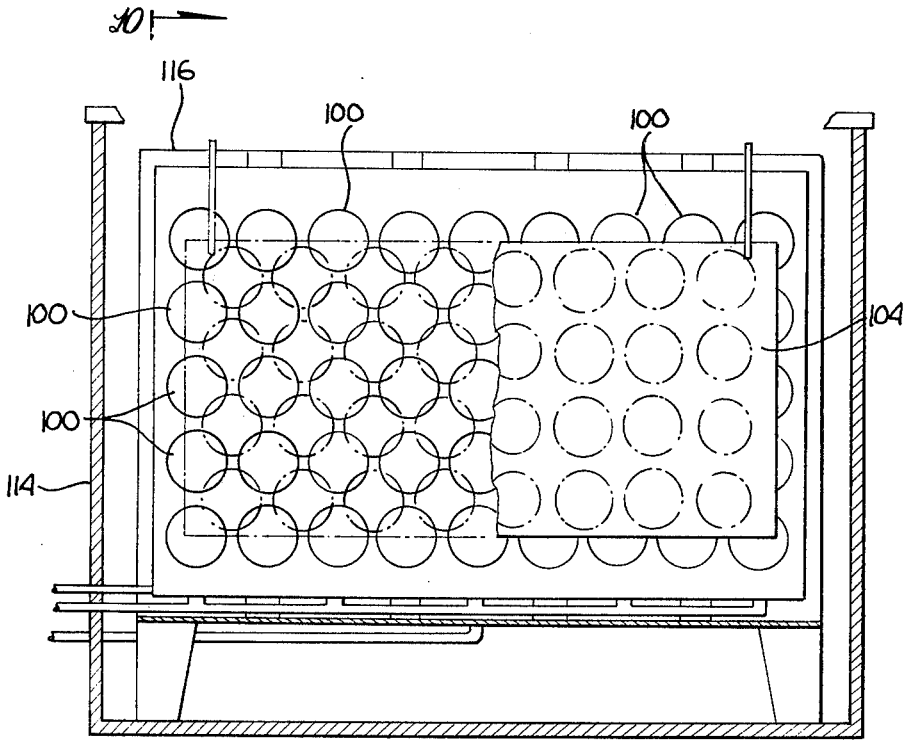
FIG. 9 is a view taken along 9—9 of FIG. 8.
Figure 10:
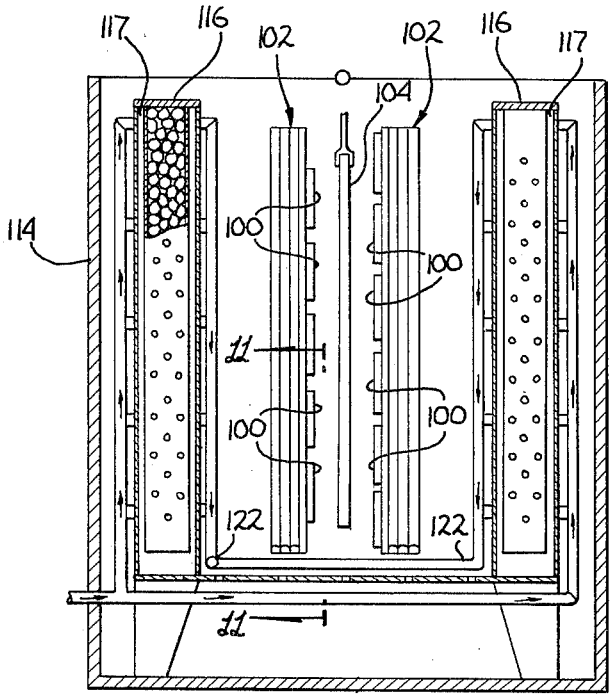
FIG. 10 is an end view taken in partial cross-section of the embodiment of FIG. 8.

Now referring to FIG. 9, a face view of a printed circuit board 104, partially cut away to show the array of heads 100 therebehind, may be seen. It will be noted that in this embodiment, as is most convenient for most embodiments, the heads 100 are generally arranged in an orthogonal array, being relatively closely spaced and preferably covering the entire area of the part to be plated, even somewhat overlapping the edges thereof. Also shown in phantom in FIG. 9 are the oppositely disposed heads illustrating the fact that in certain applications, preferably the arrays of heads on the two sides of the article to be plated are offset somewhat with respect to each other, so that the centers of delivery of the electrolyte are offset. This has the advantageous effect of improving the plating of through holes in printed circuit boards, as it allows the electrolyte to be forced through the holes rather than stagnating therein because of substantially equal pressures that would result from aligned heads.

Figure 11:
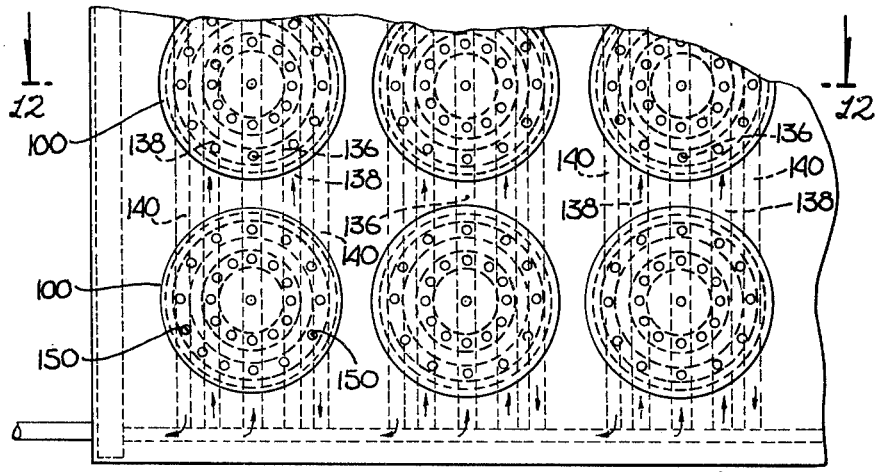
FIG. 11 is a face view of a portion of one of the manifold assemblies of the embodiment of FIG. 8 illustrating the construction thereof.
Figure 12:
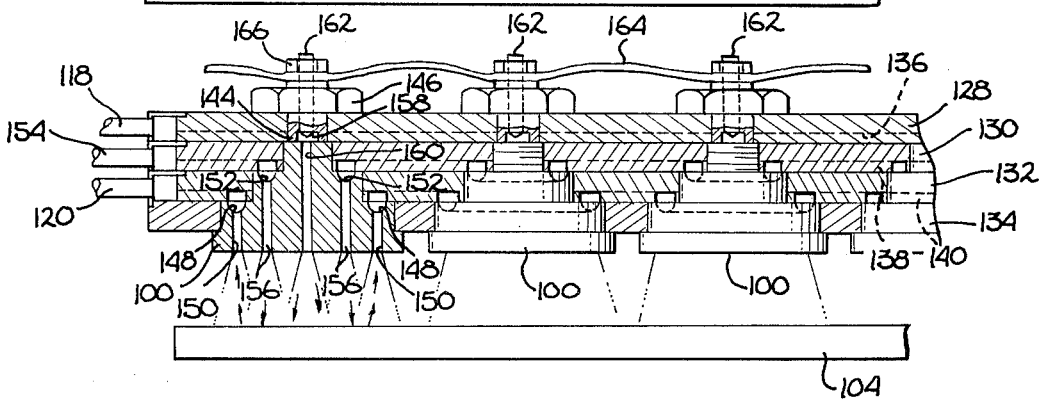
FIG. 12 is a partial cross-section of one of the manifold assemblies taken through a row of heads.

Now referring to FIGS. 11 and 12, details of the heads 100 and the manifold assemblies 102 may be seen. Each manifold assembly 102 is comprised of an assembly of individual plates 128, 130, 132 and 134 in direct face-to-face abutment, and preferably relatively tightly coupled together by a combination of the heads 100 and other coupling means, by solvent welding of the plastic plates, by a suitable adhesive or other suitable joining means. The various plates are drilled in a matrix pattern with plate 128 having the smallest hole, plate 130 a larger hole, etc., either by individual drills or by way of a progressive drill fabricated for this purpose. Also, the faces of the plates 128, 130 and 132 have a series of slots 136, 138 and 140, respectively, drilled into the faces thereof to provide passageways for plating fluids, compressed air, etc. to communicate with the heads 100. The heads themselves are characterized by an outer flange region 142, a first diameter for fitting within the opening in plate 34, a second diameter for fitting within plate 132, a third diameter for fitting within plate 130 and a shank region 144 threaded so as to receive a nut 146 for retaining the head in the assembly. Between the various stepped diameters are faces having annular channels therein to provide the required communication around the respective periphery of the head to feed the various openings therein. In particular, channel 148 communicates with the fluid passage 140, coupled in turn to line 120 for the removal of the spent electrolyte from the region of the printed circuit board 104 through openings 150 in the head. Similarly, annular region 152 communicates with the fluid passageway 138 manifolded to line 154 for delivering compressed air through openings 156. Also, an opening 158 is provided through the shank portion of the heads 100 to communicate with passageway 136 manifolded to line 118 for delivering the ion-enriched electrolyte to the central electrolyte delivery port 160. It will be noted from the view of FIG. 11 that the various fluid passageways 136, 138 and 140 are arranged and manifolded in such a way as to communicate with all heads on the assembly, more specifically being manifolded along one or opposite edges of the plates. In another embodiment, improved fluid delivery capability is achieved by an orthogonal matrix of grooves, allowing manifolding of the respective fluid delivery lines along all four edges of the assembly.

In operation, the printed circuit board or other part to be plated 104 is coupled to the cathode and the baskets 117 containing the pieces of the metal to be plated are coupled to the anode. Physically, however, in this embodiment the anode baskets are separated from the part to be plated by electrolyte containing lines of significant length. Accordingly, it has been found that plating rates are enhanced if the electrolyte contacts an anode member substantially at the point of delivery from the heads. For maximum convenience, such an anode member is preferably a nonreactive member so as not to require frequent replacement. One way of achieving the desired result is to utilize a nonreactive metallic nozzle at the outlet of the opening 160 in the heads, interconnecting the nozzles electrically for connection to the positive power supply. Another way of achieving the same basic result is illustrated in FIG. 12. In particular, stud-like members 162 of a nonreactive metal are pressed into a hole generally aligned with opening 160 so as to extend into the fluid region, the members 162 being coupled together by nonreactive and/or insulated buslines 164 retained in position on the studs 162 by nuts 166.

It is apparent from the foregoing that each head 100 will deliver a substantial stream of replenished electrolyte directly on the part to be plated, with air being injected as desired (commonly in relatively limited amounts), and with a substantial part of the spent electrolyte being removed directly from the region on which it was first directed. As such, depending upon the specific head design, a totally uniform instantaneous plating rate over a large area is not generally achievable, the plating rates generally peaking in the central region of the heads and proceeding to a minimum level in the regions between the heads. Accordingly, it is preferable either to move the heads and/or the work piece during plating in a relatively random way and by an amount of the same order of magnitude as the spacing between heads. This may readily be achieved as illustrated in FIG. 13 wherein the printed circuit board 104 being plated is supported by bars 162 coupled to cranks driven by gear motors 164. If the motors 164 operate at the same speed then the printed circuit board 104 will be translated in a circular motion. However, if the two motors operate at somewhat different speeds then the path traced by the circuit board 104 will be relatively random and nonrepetitive so as to equalize the overall plating over the entire area to a high degree of accuracy.

Now referring to FIGS. 15 and 16, a top view and a side view of an alternate form of holding an article such as printed circuit board 104 for plating may be seen. In these figures, the printed circuit board 104 has its four corners clamped by an annular clamp 166 which in turn is confined at the sides by channels 168 and supported from below by a cam 170, preferably of a high-friction, nonmetallic material such as rubber. The cam 170, rotating on a shaft 172 passing through the wall of the tank and appropriately sealed, causes both the rotation of the clamp and thus the printed circuit board, and the vertical oscillation of the clamp and circuit board, thereby also defining a relatively random orientation between the board and the heads 100 directed thereon. In this particular embodiment, a slide contact 174 provides the anode connection to the clamp.

Now referring to FIG. 14, an alternate embodiment for the manifold assemblies may be seen. In this embodiment, the heads 100*a* are similar to heads 100 of the previous embodiment, though are threaded in position into the body members 176 by the threaded portion 178. The body member 176 is an extrusion defining a first passageway 180 for the enriched electrolyte, a second passageway 182 for air, polishing media, etc., and a third passageway 184 for spent electrolyte extraction. The face of the extrusion of body member 176 into which the heads 100*a* are mounted, of course, is initially closed as extruded, thereby providing a closure for the various passageways between heads, with the openings for receipt of the heads being subsequently drilled and tapped in the extrusion. Also, for convenience of assembly, male and female dovetail connections 186 and 188 are provided at the sides of the extrusion so that the extrusions may be cut to length and assembled together to provide a manifold assembly of any reasonable dimensional requirements, with the various flow passages being manifold as required, preferably at both of the opposite edges corresponding to the open ends of the extrusions.

In the preferred forms of the present invention, the heads 100 and 100*a* are approximately one inch in diameter with the heads having a centerline spacing of $1\frac{1}{4}$ inches. The pumps 106 and 108 (FIG. 8) which have been used are one-horsepower plastic swimming pool pumps, with the pump delivering the enriched electrolyte through opening 160 in the heads (FIG. 12) providing a pressure in the range of 15 to 35 psi. The opening 160 itself may have a diameter of 0.062 inches. In one embodiment, the openings 156 have been 0.085 inches in diameter for delivering air of approximately 60 psi, with the openings 150 for the return of the spent electrolyte being approximately 0.093 inches in diameter. The random motion of the work piece itself in these embodiments has had approximately a one-inch range. Obviously, these parameters are exemplary only, as a wide range of parameters may be used depending upon the nature of the article being processed, i.e., very small for fine work to large bulk plating such as, by way of example, automobile bumpers and the like. In that regard, separate heads such as heads 100 may be eliminated if appropriately shaped extrusions are used, with the various openings characteristic of the heads being drilled directly into the extrusions to provide the desired intermixed matrix of openings. Also, it should be noted that while the invention has been disclosed with respect to the plating of flat articles, the manifold assemblies may be made in any shape to plate curved articles such as automobile bumpers and the like, or even to plate inside cans, blind holes and the like, as the local forcible removal of the electrolyte avoids the presence of stagnant electrolyte in such regions.

As before, the embodiments disclosed herein with respect to FIGS. 8 through 16 are useful not only for plating but also for such processes as deplating, etching and even simple cleaning, as a highly advantageous side-effect of being able to present ion-enriched electrolyte quickly and substantially equally distributed over the entire area of the work piece in electroplating applications is the desirable result in any application of being able to deliver any fluid in substantially equal amounts distributed over the work piece, whether etchants, cleaners or other processing fluids (rinsing, precleaners, acid etching, developers, etc.). In that regard the word "port" as used in the appended claims is used in the general sense to denote any flow facilitating means, including but not limited to simple openings, spray heads and thelike and also, the word "intermixed" as used herein and in the appended claims is used in the general sense to suggest a general form of intermingled, preferably but not necessarily in an ordered array or matrix, or in any geometrical form.

Thus, while certain embodiments of the present invention have been disclosed and described in detail herein, it will be understood by those skilled in the art that various changes in form and detail may be made therein without departing from the spirit and scope of the invention.

I claim:

1. Electroplating apparatus comprising:

a container for confining an electrolyte, said container having a sump adjacent the bottom thereof for maintaining a quantity of electrolyte, first electrode means for supporting an article to be plated above the electrolyte level in said container, said first electrode means having means for electrically coupling an article to be plated to one terminal of a power supply, manifold means adjacent said first electrode means for receiving electrolyte under pressure, said manifold means having spray means for receiving electrolyte from within said manifold means and for spraying electrolyte from a position above the electrolyte level in said container toward an article to be plated supported on said first electrode means above the electrolyte level in said container, said manifold means including at least one removable cap, said second electrode means comprising at least one electrode member of a metal electrode which is substantially nonreactive in the electrolyte for the metal to be plated, whereby pieces of the metal to be plated may be placed into said manifold means and into electrical contact with said second electrode means.

2. The apparatus of claim 1 wherein said electrode member comprises a porous basket-like member for receiving and containing pieces of the metal to be plated.

3. The apparatus of claim 1 wherein said electrode member is disposed substantially coaxially with said manifold means.

4. The apparatus of claim 1 wherein said spray means are plural spray means adjacent opposite sides of said first electrode means for spraying electrolyte onto opposite sides of an article.

5. The apparatus of claim 4 wherein said spray means are distributed below said first electrode means so as to spray the faces of an article supported under said first electrode means.

6. The apparatus of claim 1 further comprised of means for closing and sealing said container.

7. In an apparatus for treating an area of an article with a fluid, the improvement comprising:

support means for supporting an article having at least one surface to be treated, delivery means adjacent said support means for receiving a fluid and directing the fluid from a plurality of delivery ports onto said surface of the article to be treated, said delivery ports being distributed about an area corresponding to the area to be treated and return means adjacent said support means and having a plurality of return ports intermixed with said plurality of delivery ports for locally removing a fluid from the vicinity of the article to be treated.

8. The improvement of claim 7 further comprised of a third means having a plurality of ports intermixed with said delivery ports and said returns ports for delivery of an additional fluid onto the article to be treated.

9. The improvement of claim 7 further comprised of means for causing relative motion between the article to be treated and the delivery means and return means.

10. The improvement of claim 7 further comprised of means for reconditioning the fluid collected by said return means and directing the reconditioned fluid to the delivery means.

11. The apparatus of claim 7 wherein said support means and said delivery means are positioned on two opposite sides of the article to be treated, said delivery ports on one side of the article being misaligned with said delivery ports on the second side of the article.

12. In an electroplating apparatus, the improvement comprising:

first electrode means for supporting an article, said first electrode means also being a means for electrically coupling the article to one terminal of a power supply;

delivery means adjacent said first electrode means for receiving electrolyte under under pressure and directing the electrolyte from a plurality of delivery ports on said delivery means onto the article supported on said first electrode means, said delivery ports being distributed about an area corresponding to the area of the article to be plated;

return means adjacent said first electrode means, said return means having a plurality of return ports intermixed with said delivery ports on said delivery means for locally removing electrolyte from the vicinity of the article to be plated; and second electrode means for coupling to a second terminal of a power supply and for presenting to the electrolyte a metallic surface of the metal to be plated.

13. The apparatus of claim 12 wherein said second electrode means comprises a substantially nonreactive metal electrode in electrical contact with pieces of the metal to be plated.

14. The improvement of claim 12 further comprised of a third means having a plurality of ports intermixed with said delivery means and said return means for delivery of an additional fluid onto the article.

15. The improvement of claim 12 further comprised of means for causing relative motion between the article on said first electrode means and the delivery means and return means.

16. The improvement of claim 7 wherein said second electrode means is a means for ion enriching the electrolyte collected by said return means and directing the re-enriched electrolyte to the delivery means.

17. The improvement of claim 12 wherein said delivery means is a means for directing the electrolyte from a plurality of delivery locations at each side of an article on said first electrode means and said return means is a means for removing electrolyte from each side of an article on said first electrode means.

18. The improvement of claim 17 wherein said delivery locations on one side of an article in said first electrode means are not aligned with said delivery ports on the opposite side of the article.

19. The improvement of claim 12 wherein said first electrode means is an anode means and said second electrode means is a cathode means.

20. The improvement of claim 12 wherein said first electrode means is a cathode means and said second electrode means is an anode means.

21. The improvement of claim 20 further comprised of at least one nonreactive anode member adjacent said delivery ports of said delivery means and in contact with electrolyte to be delivered thereby.

22. The improvement of claim 20 wherein said cathode means is comprised of at least one enclosed anode chamber containing pieces of the metal to be plated and a nonreactive anode member in electrical contact therewith, and further comprised of a sump, a first pump and a second pump, said first pump being a means for encouraging electrolyte from said return means and through said anode chamber to said sump, said second pump being a means for removing electrolyte from said sump and directing it to said delivery means.

23. The improvement of claim 22 wherein said first electrode means is an anode means and said second electrode means is a cathode means.

24. An electroplating apparatus comprising:

a tank means;

first electrode means for supporting an article, said first electrode means also being a means for electrically coupling the article to one terminal of a power supply;

a manifold assembly adjacent said first electrode means, said manifold assembly having a first plurality of delivery ports distributed about an area corresponding to the area of an article to be plated for delivering electrolyte under pressure to the surface of an article held in said first electrode from an electrolyte delivery line, said manifold assembly also having a second plurality of return ports intermixed with said delivery ports for return of electrolyte to a return line;

a second electrode means for coupling to a second terminal of power supply and for presenting to the electrolyte a metallic surface of the metal to be plated; and pump means for encouraging electrolyte from said return line past said second electrode means and to said delivery line.

25. The improvement of claim 24 further comprised of at least one nonreactive anode member adjacent said delivery ports of said delivery means and in contact with electrolyte to be delivered thereby.

26. The improvement of claim 24 further comprised of a third means having a plurality of ports intermixed with said delivery means and said return means for delivery of an additional fluid onto the article.

27. The improvement of claim 24 further comprised of means for causing relative motion between the article on said first electrode means and the delivery means and return means.

28. The improvement of claim 23 wherein said cathode means is comprised of at least one enclosed anode chamber containing pieces of the metal to be plated and a nonreactive anode member in electrical contact therewith.

* * * * *

UNITED STATES PATENT AND TRADEMARK OFFICE

CERTIFICATE OF CORRECTION

PATENT NO. : 4,174,261

DATED : November 13, 1979

INVENTOR(S) : Peter P. Pellegrino

It is certified that error appears in the above-identified patent and that said Letters Patent are hereby corrected as shown below:

Column 2, line 32, misspelled "interupt",
should be -- interrupt --

Column 6, line 35, misspelled "interupt",
should be --interrupt --

Column 11, line 1, placed "if" any,
should be -- in --

Column 13, line 21, misspelled "manifold",
should be --manifolded --

Column 14, line 3, and "thelike" and,
should be -- the like --

Signed and Sealed this

*Twenty-third* Day of *February 1982*

[SEAL]

*Attest:*

GERALD J. MOSSINGHOFF

*Attesting Officer*

*Commissioner of Patents and Trademarks*